US009855182B2

(12) United States Patent
Chou

(10) Patent No.: US 9,855,182 B2
(45) Date of Patent: Jan. 2, 2018

(54) PHYSIOTHERAPEUTIC DEVICE

(71) Applicant: Shan-Lau Chou, New Taipei (TW)

(72) Inventor: Shan-Lau Chou, New Taipei (TW)

( * ) Notice: Subject to any disclaimer, the term of this patent is extended or adjusted under 35 U.S.C. 154(b) by 514 days.

(21) Appl. No.: 14/568,127

(22) Filed: Dec. 12, 2014

(65) Prior Publication Data

US 2016/0166461 A1 Jun. 16, 2016

(51) Int. Cl.

| | |
|---|---|
| ***A61H 1/02*** | (2006.01) |
| ***A63B 23/02*** | (2006.01) |
| *A63B 23/00* | (2006.01) |

(52) U.S. Cl.

CPC ..... *A61H 1/0292* (2013.01); *A63B 23/0238* (2013.01); *A61H 2201/1215* (2013.01); *A61H 2201/149* (2013.01); *A61H 2201/164* (2013.01); *A61H 2201/1664* (2013.01); *A61H 2203/0456* (2013.01); *A63B 2023/006* (2013.01)

(58) Field of Classification Search

CPC ..... A61H 1/02; A61H 1/0218; A61H 1/0229; A61H 1/0237; A61H 1/0292

See application file for complete search history.

(56) References Cited

U.S. PATENT DOCUMENTS 2,633,124 A * 3/1953 Yellin ..... A61H 1/0218 297/392
2,633,125 A * 3/1953 Yellin ..... A61F 5/04 602/32
2,796,861 A * 6/1957 Smith ..... A61H 1/02 601/26
2,910,061 A * 10/1959 Rabjohn ..... A61H 1/0218 602/33
3,768,464 A * 10/1973 Greissing ..... A61H 1/02 602/32
3,835,847 A * 9/1974 Smith ..... A61H 1/0218 602/32
3,888,243 A * 6/1975 Powlan ..... A61G 7/05 602/32
4,360,009 A * 11/1982 Weisman ..... A61G 13/009 606/244
5,722,941 A * 3/1998 Hart ..... A61F 5/04 602/32

* cited by examiner

*Primary Examiner* — LaToya M Louis
(74) *Attorney, Agent, or Firm* — Leong C. Lei

(57) ABSTRACT

The physiotherapeutic device provides periodic upward pulling to a user's legs by driving a sliding member back and forth within a shaft. The sliding member is joined to a suspension member where the user's legs are suspended in handle rings of the suspension member. As the sliding member moves downward, a cushion member provides safe and smooth relaxation to the user's spine.

8 Claims, 6 Drawing Sheets

PHYSIOTHERAPEUTIC DEVICE

BACKGROUND OF THE INVENTION (a) Technical Field of the Invention

The present invention is generally related to physiotherapeutic device, and more particular to a physiotherapeutic device for treating spinal cord pathology.

(b) Description of the Prior Art

The human skeletal structure, especially the vertebral column or spine, supports the various tissues and organs. The spine consists of 7 cervical vertebrae, 12 thoracic vertebrae, 5 lumbar vertebras, a sacrum, and a coccyx, and the spinal cord runs through the vertebrae. If a vertebra is dislocated and the spinal cord is pressurized, pain and discomfort to the limbs as well as some internal organs are caused.

For serious spinal cord pathology, surgery is usually required. For mild symptoms, electrical stimulation, lumbar belt, or lumbar support is usually employed, or manipulation or massage by a therapist is applied. For the latter, if the manipulation or massage is not conducted carefully, it could severe the neurothlipsis or cause injury to the patient's muscle or ligament, bone fracture, or even stroke or paralysis.

SUMMARY OF THE INVENTION

Therefore a novel physiotherapeutic device is provided herein obviating the shortcomings of the prior art.

A major objective of the present invention is to provide periodic stretch to a user's spine.

The physiotherapeutic device contains a base, a shaft on the base, a sliding member movably configured within the shaft, a driving member, a cushion member, and a suspension member. Two opposing slots are configured on a circumference of the shaft. The sliding member contains two opposing pins extended radially from a circumference of the sliding member through the slots, respectively. The driving member drives one of the pins so that the sliding member moves back and forth within the shaft. The cushion member is configured between the shaft and the base, and engages the other pin to smooth a downward movement of the sliding member. The suspension member is joined to the sliding member and contains handle rings for placing a user's legs. As such, the user's legs are pulled up and down periodically, thereby providing safe and periodic stretching and relax to the user's spine.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
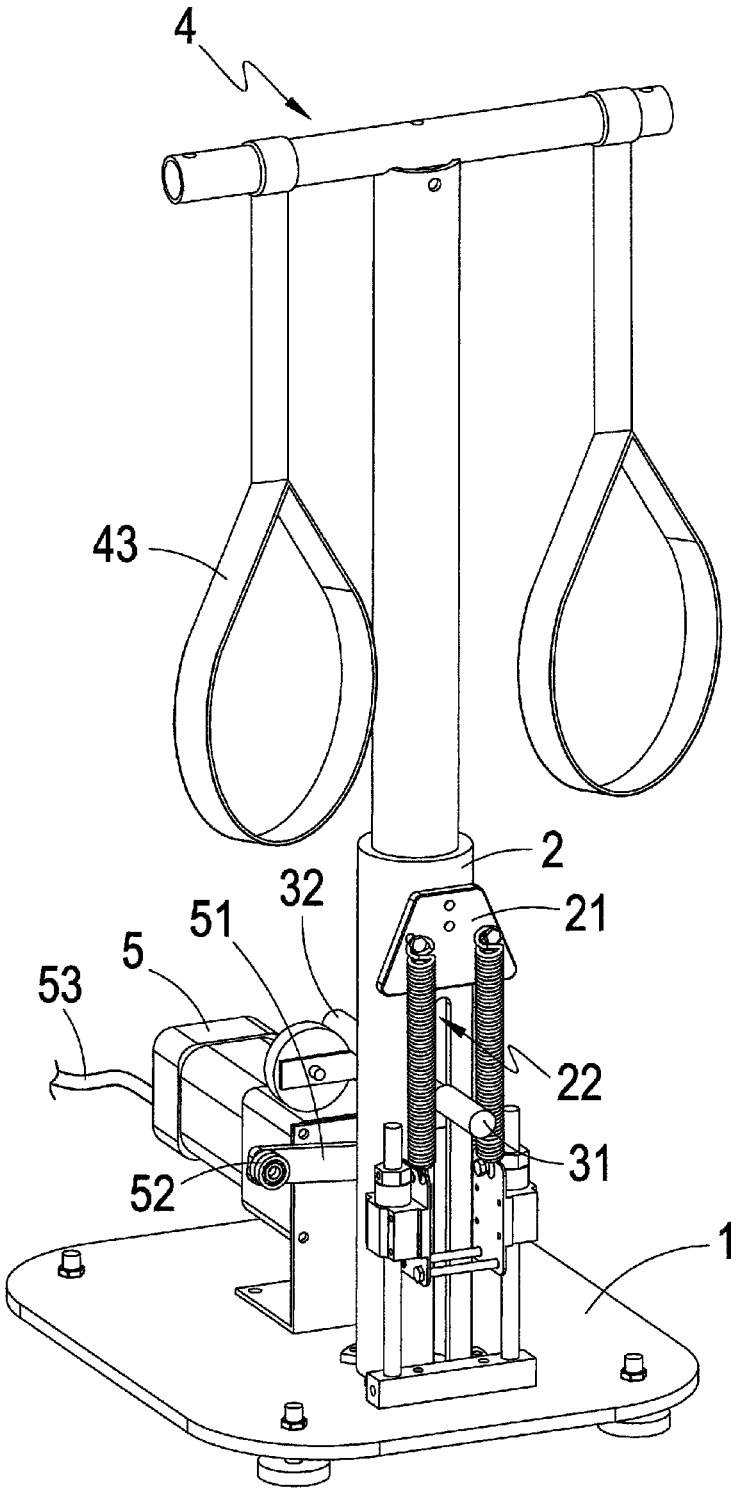
FIG. 1 is a perspective diagram showing a physiotherapeutic device according to an embodiment of the present invention.
Figure 2:
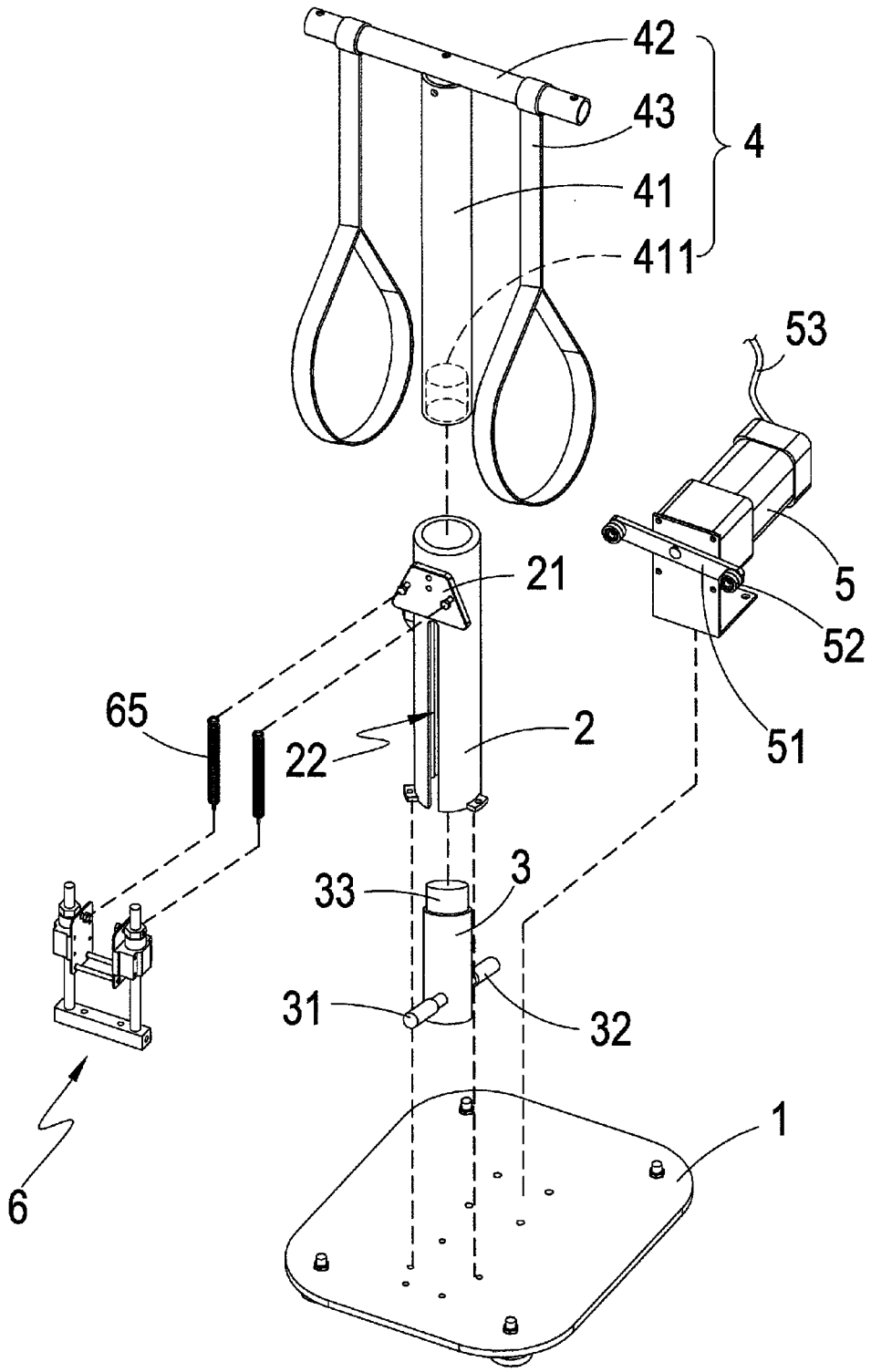
FIG. 2 is a perspective break-down diagram showing the various components of the physiotherapeutic device of FIG. 1.
Figure 3:
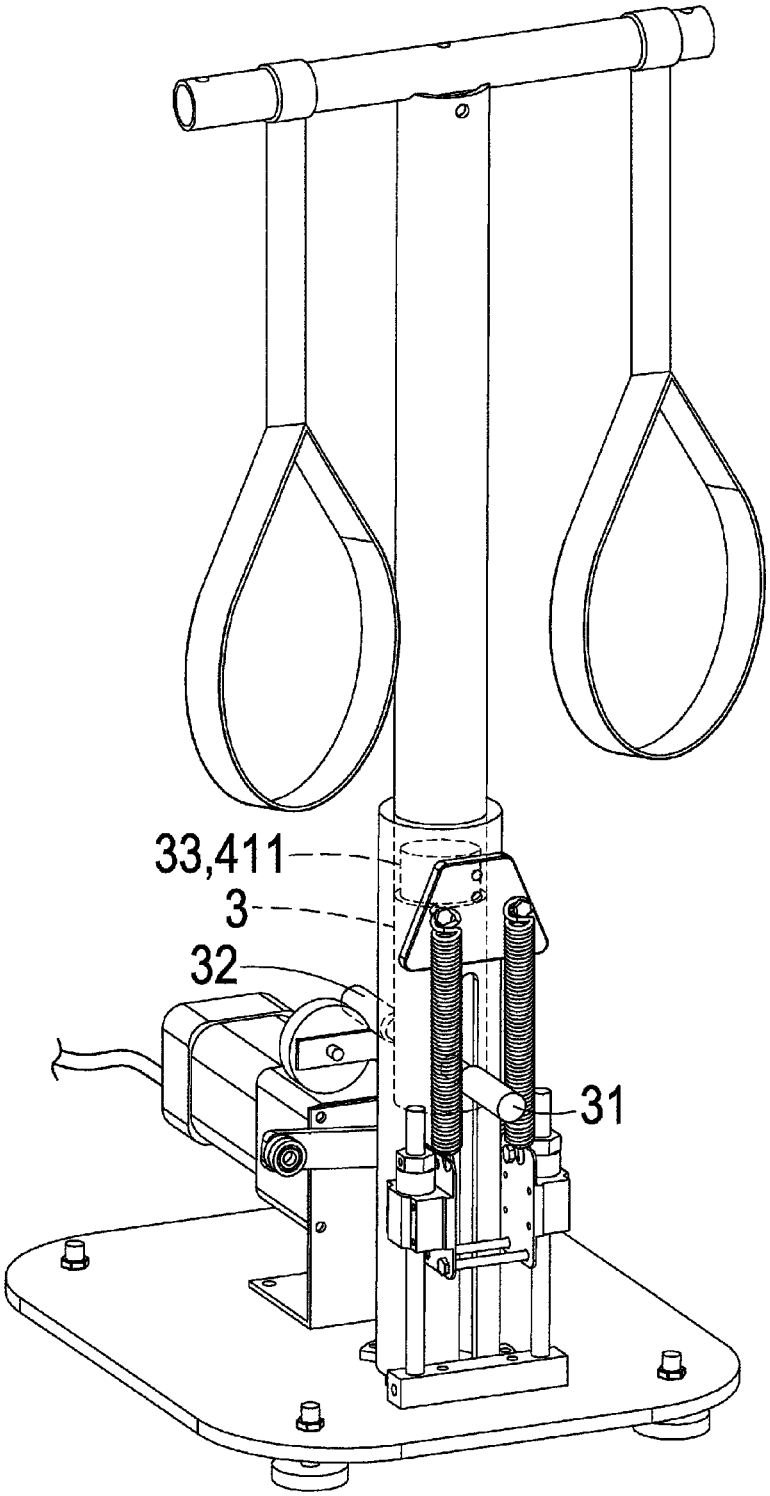
FIG. 3 is schematic diagram showing details inside the physiotherapeutic device of FIG. 1.
Figure 4:
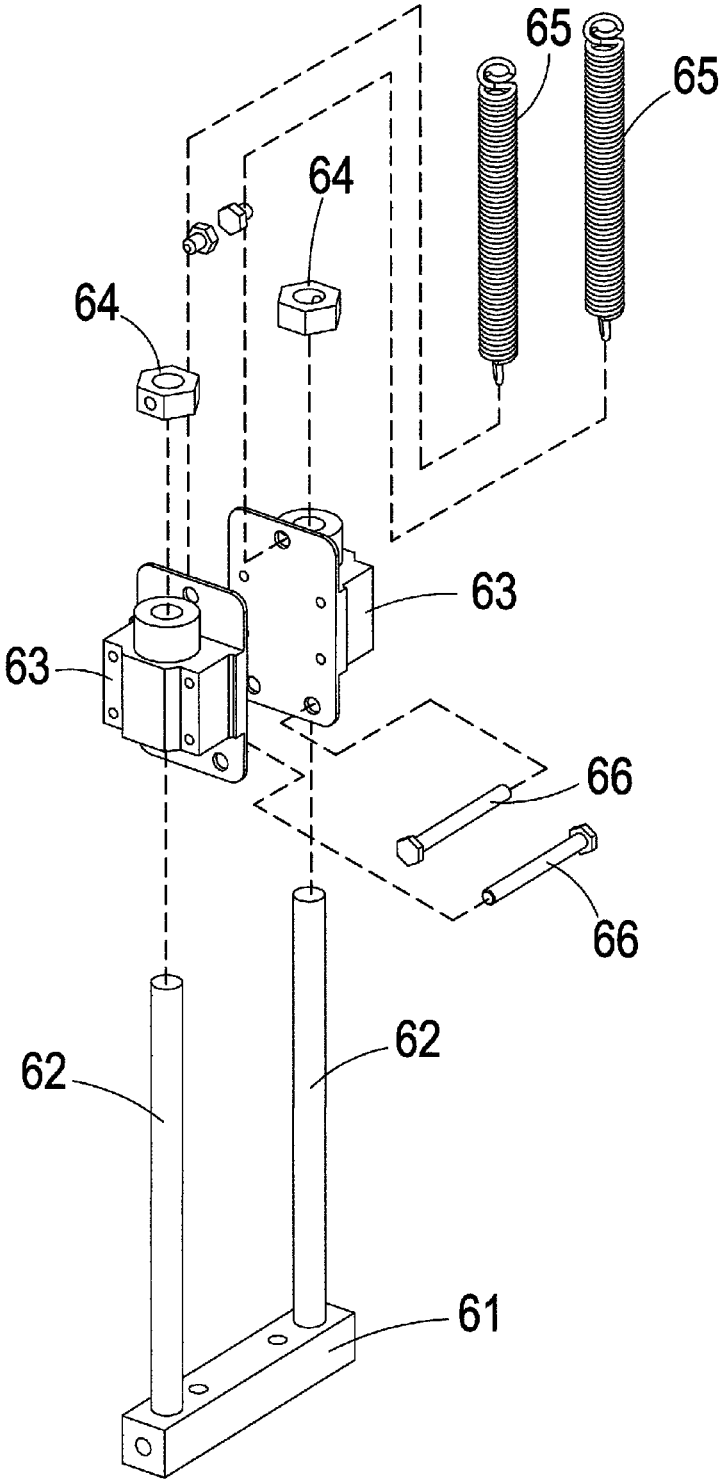
FIG. 4 is a perspective break-down diagram showing the various components of a cushion member of the physiotherapeutic device of FIG. 1.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As illustrated in FIGS. 1 to 6, a physiotherapeutic device according to an embodiment of the present invention contains the following components.

There is a flat base 1.

A tubular shaft 2 is raised upward and perpendicularly from a top side of the base 1. Two opposing slots 22 are configured on a circumference of the shaft 2. Above one slot 22, a plate 21 is fixedly attached to the circumference of the shaft 2.

A cylindrical sliding member 3 is movably housed in the shaft 2. A first pin 31 and a second pin 32 are oppositely and radially extended from a circumference of the sliding member 3, and penetrate through the slots 22, respectively. A cylindrical connection element 33 is configured on a top end of the sliding member 3 for joining a suspension member 4.

A driving member 5 is configured on the top side of the base 1. The driving member 5 engages the second pin 32 through an auxiliary wheel (not numbered) so that the sliding member 3 slides back and forth within the shaft 2.

A cushion member 6 is configured on the top side of the base 1 and is connected to the plate 21. The cushion member 6 is engaged by the first pin 31 as the sliding member 3 moves downward towards the base 1.

The driving member 5 can be a motor and an axle of the motor is perpendicularly joined to a linear piece 52 where a roller 52 for engaging the second pin 32 through an auxiliary wheel (not numbered) is configured at an end of the piece 52.

The sliding member 3 has a reversed T shape with the two pins 31 and 32 configured adjacent to a bottom end oppositely to the top end of the sliding member 3. The bottom end of the sliding member 3 is the end closest to the base 1.

The suspension member 4 contains a tubular beam 42 and a tubular column 41 whose top end is perpendicularly joined to a center of the beam 42, thereby forming a T shape. At each end of the beam 42, at least a handle ring 42 is attached for suspending a user's leg. A socket 411 is configured at a bottom end oppositely to the top end of the column 41 for joining to the connection element 33.

The cushion member 6 contains the following components.

A seat 61 is fixedly joined to the top side of the base 1.

A number of poles 62 are raised upward in parallel and perpendicularly from the seat 61.

A sliding block 63 is movably configured on each pole 62.

A limiting element 64 is configured adjacent to a top end of each pole 62 for limiting how far upward the block 63 on each pole 62 can move.

There are a number of elastic elements 65, each having one end joined to the plate 21 and another end joined to a block 63.

At least a bar 66 is configured laterally by having its both ends joined to two blocks 63, respectively. Each bar 66 will be engaged by the first pin 31 as the sliding member 3 moved downward towards the base 1.

Each elastic element 65 can be a spring. The driving member 5 has a power cable 53 for connecting the driving member 5 to a power source.

Figure 5:
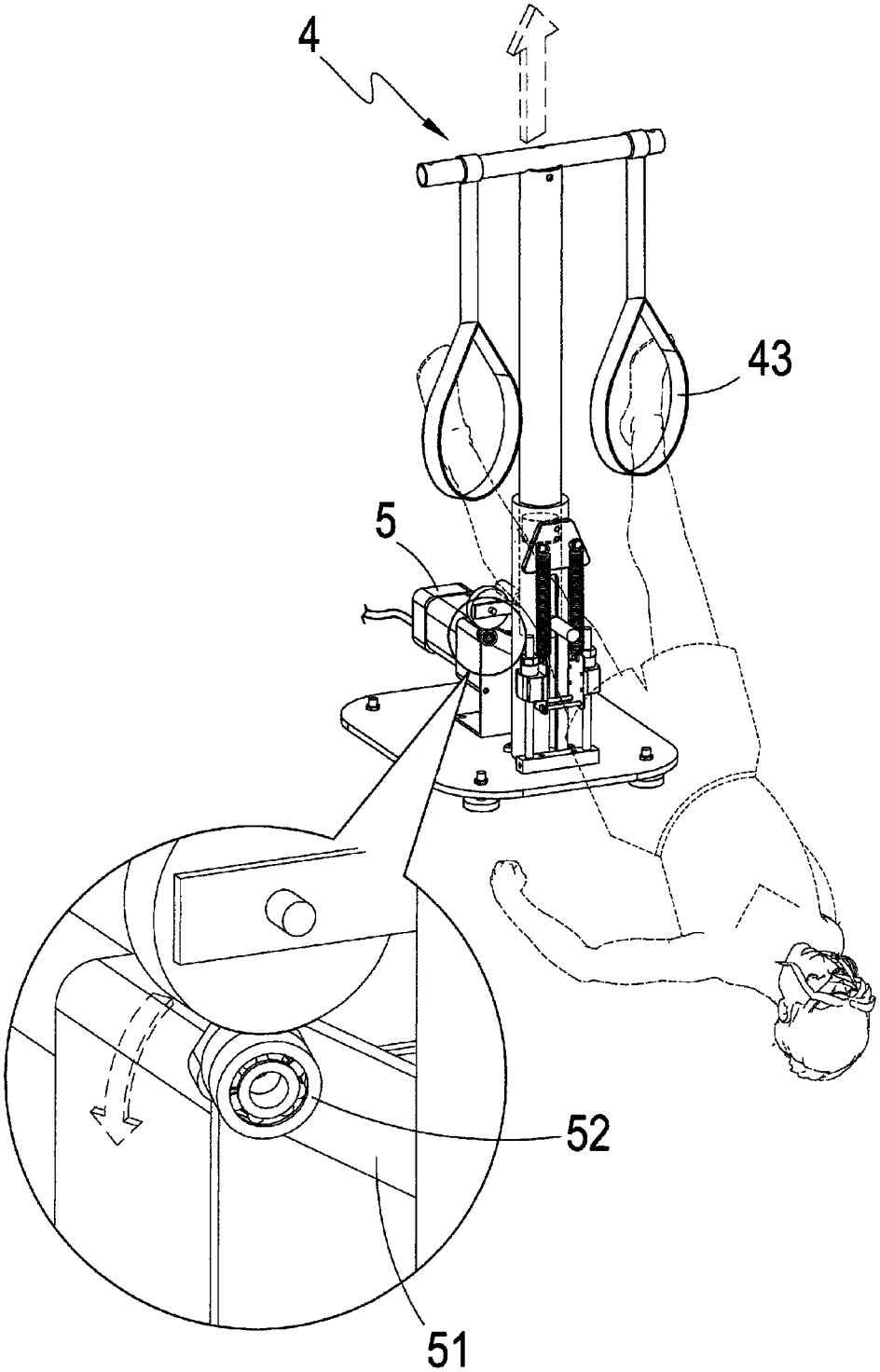
FIG. 5 is a perspective diagram showing the treating to a user by the physiotherapeutic device of FIG. 1.
Figure 6:
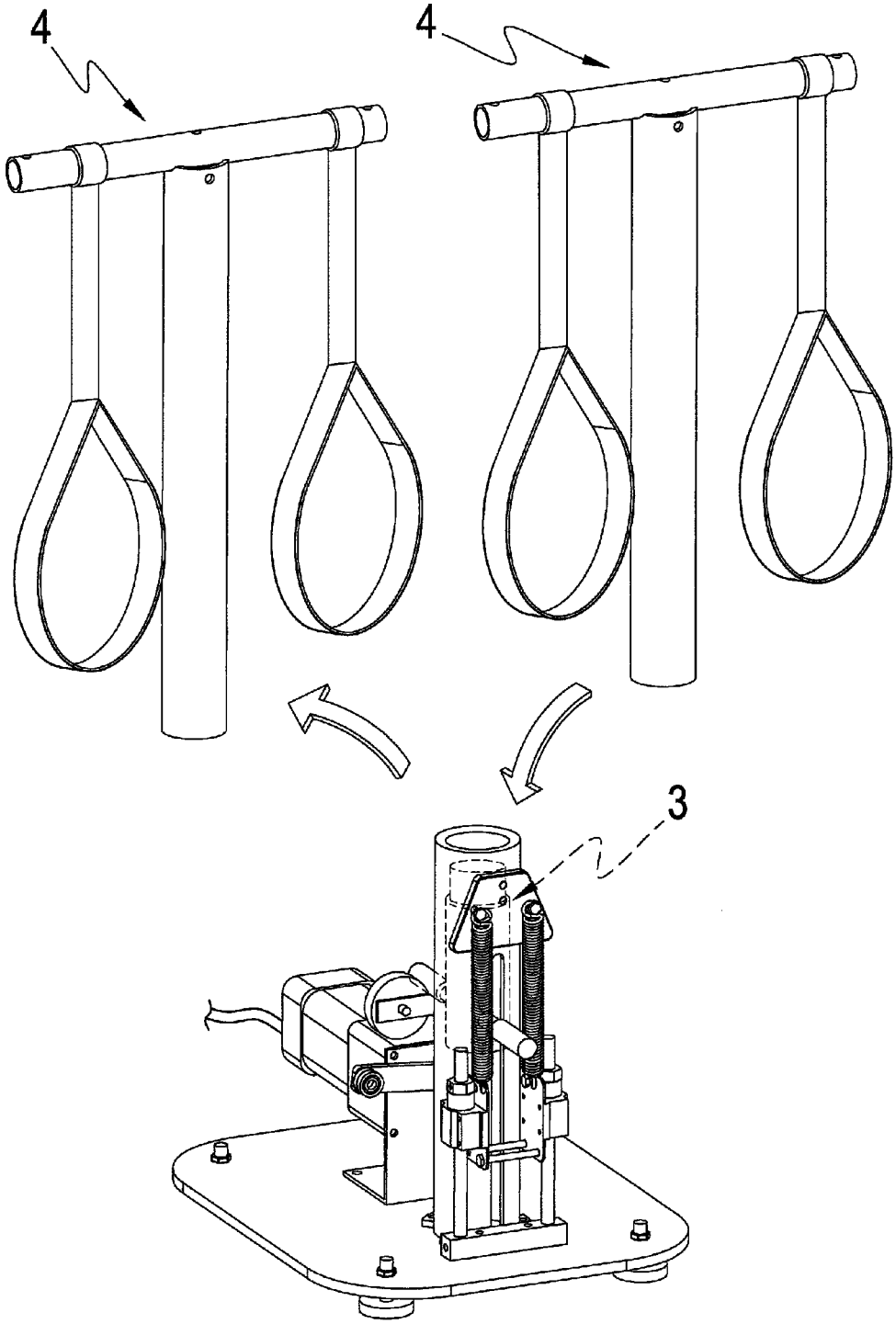
FIG. 6 is a perspective diagram showing the replacement of a suspension member of the physiotherapeutic device of FIG. 1

As shown in FIG. 5, when the driving member 5 is powered up, the arm 51 rotates and a roller 52 raises the second pin 32 upward through an auxiliary wheel (not numbered). The suspension member 4 therefore moves upward as the sliding member 3 slides within the shaft 2. A user's leg in the handle ring 43 then is pulled upward. As the arm 51 continues to rotate, the second pin 32 loses the roller 52's raise and the sliding member 3 drops quickly downward. The sliding member 3 then hits the bars 66, forcing the blocks 63 to slide downward along the poles 62. But the hit by the sliding member 3 is cushioned by the elastic elements 65. As the arm 51 keeps rotating, the above-described process is repeated over and over again, thereby achieving safe and periodic stretching and relax to the user's spine. As shown in FIG. 6, for users of different conditions, different suspension members 4 can be used accordingly. The suspension member 4 can be conveniently detached from the sliding member 3. Then a different suspension member 4 can be installed by plugging the connection element 33 into the socket 411.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A physiotherapeutic device, comprising a base;

a shaft raised upward and perpendicularly from a top side of the base having two opposing slots configured on a circumference of the shaft where a plate is fixedly attached to the circumference of the shaft above one slot; a sliding member movably housed in the shaft where the sliding member comprises a first pin, a second pin, and a connection element; a driving member configured on the top side of the base engaging the second pin so that the sliding member slides back and forth within the shaft; a cushion member configured between the top side of the base and the plate where the cushion member is engaged by the first pin as the sliding member moves downward towards the base; and a suspension member having a T shape comprising a socket configured at a bottom end for joining to the connection element;

wherein the cushion member comprises:

a seat fixedly joined to the top side of the base;

a plurality of poles extending upward in parallel and perpendicularly from the seat;

a sliding block movably configured on each pole:

a limiting element configured adjacent to a top end of each pole for limiting how far upward the block on each pole can move:

a plurality of elastic elements, each having one end joined to the plate and another end joined to one of the blocks: and at least a bar configured laterally by having its both ends joined to two of the blocks, respectively, where each bar is engaged by the first pin as the sliding member is moved downward towards the base.

2. The physiotherapeutic device according to claim 1, wherein the driving member is a motor; and an axle of the motor is perpendicularly joined to a linear piece where a roller for engaging the second pin is configured at an end of the piece.

3. The physiotherapeutic device according to claim 1, wherein the first pin and the second pin are oppositely and radially extended from a circumference of the sliding member, and penetrate through the slots, respectively.

4. The physiotherapeutic device according to claim 3, wherein the connection element is configured on a top end of the sliding member for joining the suspension member.

5. The physiotherapeutic device according to claim 1, wherein the suspension member comprises a beam, a column whose top end is perpendicularly joined to a center of the beam, and at least a handle ring attached to each end of the beam for suspending a user's leg.

6. The physiotherapeutic device according to claim 5, wherein the socket is configured at a bottom end oppositely to the top end of the column for joining to the connection element.

7. The physiotherapeutic device according to claim 1, wherein elastic element is a spring.

8. The physiotherapeutic device according to claim 1, wherein the driving member has a power cable for connecting the driving member to a power source.

* * * * *